US011761603B2

(12) United States Patent
Lu et al.

(10) Patent No.: US 11,761,603 B2
(45) Date of Patent: Sep. 19, 2023

(54) FRONT-LIGHTING SYSTEM FOR VEHICLE

(71) Applicant: Lumileds LLC, San Jose, CA (US)

(72) Inventors: Kang Lu, Shanghai (CN); Ping Wu, Shanghai (CN); Jun Zhang, Shanghai (CN)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/633,483

(22) PCT Filed: Aug. 5, 2020

(86) PCT No.: PCT/EP2020/071952

§ 371 (c)(1),
(2) Date: Feb. 7, 2022

(87) PCT Pub. No.: WO2021/023755

PCT Pub. Date: Feb. 11, 2021

(65) Prior Publication Data

US 2022/0282846 A1 Sep. 8, 2022

(30) Foreign Application Priority Data

Aug. 7, 2019 (WO) ..... PCT/CN2019/099608
Aug. 22, 2019 (EP) ..... 19193120

(51) Int. Cl.

| | |
|---|---|
| ***F21S 41/43*** | (2018.01) |
| ***F21S 41/25*** | (2018.01) |
| ***F21S 41/365*** | (2018.01) |
| ***F21S 41/143*** | (2018.01) |
| ***F21S 41/148*** | (2018.01) |

(Continued)

(52) U.S. Cl.
CPC ..... *F21S 41/43* (2018.01); *F21S 41/143* (2018.01); *F21S 41/148* (2018.01); *F21S 41/153* (2018.01); *F21S 41/25* (2018.01); *F21S 41/321* (2018.01); *F21S 41/365* (2018.01); *F21W 2102/13* (2018.01)

(58) Field of Classification Search
None
See application file for complete search history.

(56) References Cited

U.S. PATENT DOCUMENTS

2014/0321141 A1 10/2014 Bauer et al.

FOREIGN PATENT DOCUMENTS

CN 205 619 152 U 10/2016
EP 3 473 917 A1 4/2019

(Continued)

*Primary Examiner* — Elmito Breval
(74) *Attorney, Agent, or Firm* — Volpe Koenig

(57) ABSTRACT

A system includes a first primary optics that receives light from a first light source and projects it onto a transparent shutter and a secondary optics. A second primary optics receives light from the second light source and projects it onto the transparent shutter. The transparent shutter receives light from the first light source via the first primary optics and prevents a lower part of it from entering the secondary optics. The transparent shutter further receives light from the second light source via the second primary optics and projects it onto the secondary optics. The secondary optics receives light from the first primary optics and the transparent shutter and projects it onto a road in front of the vehicle. The transparent shutter includes an air-exposed slit that redirects the light received by the transparent shutter from the second light source toward a middle axis of the transparent shutter.

17 Claims, 4 Drawing Sheets

(51) Int. Cl.

| | |
|---|---|
| ***F21S 41/153*** | (2018.01) |
| ***F21S 41/32*** | (2018.01) |
| *F21W 102/13* | (2018.01) |

(56) References Cited

FOREIGN PATENT DOCUMENTS

| | | | |
|---|---|---|---|
| WO | 2013/075157 | A1 | 5/2013 |
| WO | 2018/192963 | A1 | 10/2018 |

FRONT-LIGHTING SYSTEM FOR VEHICLE

CROSS REFERENCE TO RELATED APPLICATIONS

This application is a § 371 application of International Application No. PCT/EP2020/071952, filed Aug. 5, 2020, which claims the benefit of EP Patent Application No. EP 19193120.3, filed Aug. 22, 2019, and International Application No. PCT/CN2019/099608, filed Aug. 7, 2019, which are incorporated by reference as if fully set forth.

FIELD OF THE INVENTION

The present invention relates to the field of automotive front-lighting, and particularly to a front-lighting system for a vehicle.

BACKGROUND OF THE INVENTION

Bi-function Poly-Ellipsoidal System (PES) solution for a headlamp has been widely used in automotive lighting today. Generally speaking, an opaque shutter is utilized in this solution to enable switching between a high beam (also known as an upper beam) and a low beam (also known as a lower beam). In such an approach, due to a thickness of the opaque shutter itself, a dark area exists in the final projected beam pattern, especially between the high beam and the low beam.

In order to avoid the dark area as indicated above, it has been proposed to use a transparent shutter instead of an opaque one in an automotive lighting system, see e.g. WO2018192963A1 and CN205619152U. However, due to limitations in size of optical elements, such as of the transparent shutter itself, the light beam input from the light source, such as the low-beam light source and the high-beam light source, shall be narrow enough such that undesired refraction out of the transparent shutter is avoided for example at some edges thereof, for the purpose of reducing the loss of light and improving the quality of beam pattern. To this end, in a conventional front-lighting system for a vehicle, especially those equipped with a transparent shutter, a single low-beam light source and also a single high-beam light source, in particular both having small lateral sizes, are used. Although this helps to avoid the dark shadow caused by an opaque shutter between the low-beam pattern and the high-beam pattern, problems do exist due to limitations in the small size and further the low light intensity of light sources themselves. Those problems are extremely notable for the high-beam light pattern because it is normally required to provide a light intensity strong enough to give a bright and clear view for drivers.

SUMMARY OF THE INVENTION

The present invention provides a front-lighting system for a vehicle, so as to eliminate or at least alleviate one or more of the above mentioned disadvantages.

According to an embodiment of the present invention, a front-lighting system is proposed for a vehicle. The front-lighting system comprises a first light source, a second light source, a first primary optics, a second primary optics, a transparent shutter, and a secondary optics. Preferably, the first light source comprises a low-beam light source and the second light source comprises a high-beam light source, and vice versa. In this way, two separate light sources are used respectively for providing the high beam pattern and the low beam pattern.

Specifically, the first primary optics is designed to receive light from the first light source and project it onto the transparent shutter and the secondary optics. As an example, the first primary optics can be selected as a first reflector and/or comprise a reflective light in-coupling surface. Alternatively, a first collimator may also be used, and/or a refractive light in-coupling surface may be comprised in the first primary optics. In case that the first primary optics is designed to be a first collimator, not only a projection of light from the first light source onto the transparent shutter and the secondary optics can be achieved, but also a beam shaping of the same light will be obtained. Besides, the refractive light in-coupling surface of the first primary optics can be further configured for near field focusing other than collimation.

In a similar way, a second primary optics is also provided, which second primary optics is designed to receive light from the second light source and project it onto the transparent shutter. Again, the second primary optics can be chosen as a second reflector or a second collimator. Specifically, the second reflector is configured to reflect the light emitted by the second light source towards the transparent shutter. As for the second collimator, it is arranged for collimating the light emitted by the second light source towards the transparent shutter. In other words, the second reflector and collimator are used herein to perform preliminary processing on the light emitted from the second light source prior to entering the transparent shutter. Besides, the second collimator also helps to shape the light beam emitted from the second light source. In a particular embodiment, the second collimator can also be integrated with the transparent shutter, such as on its entrance side facing the second light source. As similar to the first primary optics, the second primary optics may also comprise a light in-coupling surface, especially, a reflective or refractive light in-coupling surface. In this case, not only a projection of light from the second light source can be obtained, but also collimation or near field focusing of the same light will be achieved.

Additionally, the transparent shutter is designed to receive light from the first light source via the first primary optics and prevent a lower part of it from entering the secondary optics. In this case, the lower part of light coming out of the first light source will not form any image through the secondary optics, and only the upper part thereof goes into the secondary optics. This helps to form a low beam pattern with a clear cut-off line for example, if the first light source is chosen as a low-beam light source. In such a way, the dark area between the two beam patterns, such as between the high beam pattern and the low beam pattern, caused by any traditional opaque shutter can also be avoided. Further, with regard to the second beam portion emitted from the second light source, the transparent shutter is designed to receive it via the second primary optics and then project it onto the secondary optics. In combination with the secondary optics, a second beam pattern, such as a high beam pattern if the second light source is selected to be a high-beam light source, can be projected onto a road.

Specifically, in an optional embodiment, the secondary optics is designed to receive light from both the first primary optics and the transparent shutter, and project it onto the road in front of the vehicle. As an optional instance of the above embodiment, a projection lens can be used as the secondary optics.

Furthermore, in an embodiment of the above proposed front-lighting system, the transparent shutter also comprises an air-exposed slit, which air-exposed slit is carved within the transparent shutter and configured further to redirect the light received by the transparent shutter from the second light source towards a middle axis of the transparent shutter. According to an example instance of the above embodiment, the transparent shutter can be shaped to have a cylinder portion where the air-exposed slit is located, and the middle axis will be a symmetric axis of the cylinder portion. By providing the air-exposed slit with such a configuration that light received by the transparent shutter from the second light source is redirected towards the middle axis of the transparent shutter, the part of light beam incident onto the transparent shutter from the second light source is allowed to be concentrated more towards a middle portion of the transparent shutter as compared with that towards outer sides of the transparent shutter. This helps at least to reduce a larger input light beam, such as from the second light source, into a smaller one, thus contributing to a decreased loss of light for example due to a reduced outward refraction at outer sides of the transparent shutter.

In an optional embodiment of the present invention, the transparent shutter comprises different optical surfaces, such as a light out-coupling surface at which light is out-coupled from the transparent shutter towards the secondary optics. The light out-coupling surface is for example designed to be flat or in a free form, thus allowing change in the out-coupling angle and/or distribution of output light. Preferably, in an example instance of the above mentioned embodiment according to the present invention, the air-exposed slit is further designed to redirect the light received by the transparent shutter from the second light source into a concentrated light spot on the light out-coupling surface of the transparent shutter. In this case, light coming out of the second light source and being incident into the transparent shutter is not only redirected more towards a middle section of the transparent shutter, but also concentrated into a light spot, especially a narrowed one, onto the light out-coupling surface of the transparent shutter. Further preferably, the concentrated light spot as redirected by the air-exposed slit onto the light out-coupling surface of the transparent shutter also comprises such a distribution that light intensity is largest at the center of the light spot and decreases gradually towards outer edges thereof. In this way, a light spot with the desired distribution of light intensity can be output, such as for a high beam part of the final beam pattern projected onto the road, if a high-beam light source is used as the second light source.

Schematically, according to an optional embodiment of the present invention, in the above proposed front-lighting system for a vehicle, the air-exposed slit of the transparent shutter extends perpendicularly to a propagation direction of light from the second light source within the transparent shutter. A perpendicular extension of the air-exposed slit within the transparent shutter allows an efficient and optionally symmetric redirection of light input from the second light source towards a middle section of the transparent shutter, leading to a minimum loss of light caused by such a redirection. According to an example embodiment of the present invention, the transparent shutter is shaped to have a cylinder portion where the air-exposed slit is located, and the propagation direction of light from the second light source is roughly going down along the symmetry axis of the cylinder portion. In this case, within the transparent shutter, the extension direction of the air-exposed slit will be orthogonal to the symmetry axis of the cylinder portion.

In the above proposed front-lighting system for a vehicle, not only a transparent shutter is used, but also an air-exposed slit is carved therein for at least redirecting light input from the second light source, such that no shading of light transmission is caused by the shutter on the one hand, and on the other hand, the part of light input from the second light source is concentrated in size and optionally provided with a desired distribution of light intensity. In this case, usage is allowed of a larger sized, second light source, or possibly of multiple second light sources configured for example in an array, thus enabling potential acquisition of a desired high beam pattern with the required light intensity and overall amount of light output from the front-lighting system if a high-beam light source is used as the second light source.

According to an optional embodiment of the present invention, in the above proposed front-lighting system for a vehicle, the second light source comprises a plurality of sub-light sources arranged for example in an array of (2m+1) rows and (2n+3) columns, where m and n are both integers equal to or greater than 0. In the above embodiment, further optionally, the air-exposed slit comprises one or more sub-slits, each sub-slit extending in parallel to a respective row of the sub-light sources. As can be seen, in the proposed front-lighting system, multiple individuals in one or more rows are used for the second light source, and accordingly, one or more sub-slits are provided, where each sub-slit is associated with one respective row of the sub-light sources. For example, if the transparent shutter is disposed above the array of sub-light sources of the second light source, where light from the second light source runs from the bottom to up through the transparent shutter, each sub-slit will extend horizontally above the respective row of sub-light sources.

Furthermore, in an example instance of the above described embodiment, each sub-slit also comprises two side parts, wherein each part is located on either side of a middle part of the transparent shutter, which middle part is exempted from the air-exposed slit, i.e., from the one or more sub-slits. In other words, in the front-lighting system as proposed by the present invention, the transparent shutter comprises a middle part (also called a middle section hereinafter), for example a cylinder part around its middle axis, and each sub-slit consists of two independent side parts, each side part being located at either side of the middle part of the transparent shutter. This means that each sub-slit is not cutting through the transparent shutter, at least with no perforation at the middle part of the transparent shutter. This helps to maintain the transparent shutter in a one-piece construction, and also makes it easier for manufacturing or machining the transparent shutter.

According to an example instance of the above embodiment, in the transparent shutter of the front-lighting system, each sub-slit further comprises a first surface and a second surface opposite to each other. To be specific, as compared with the second surface, the first surface of each sub-slit is positioned closer to a light entrance surface of the transparent shutter, where light from the second light source is incident thereon. As an example, if the transparent shutter is positioned above the second light source, and light from the second light source is propagating from the bottom to up within the transparent shutter, the first and second surfaces of each sub-slit will be the lower and upper surfaces respectively. Furthermore, both of the first surface and the second surface comprise at least portions located at the two side parts of each sub-slit, which portions are shaped such that light incident thereon is redirected to be inclined towards the middle part of the transparent shutter, especially relating to a middle-positioned sub-slit. It should be indicated that in the above expression, the term of "middle-positioned sub-slit" refers to that having an equal number of sub-slits at either side thereof. In other words, if an odd number of rows are provided of sub-slits, the middle-positioned sub-slit shall be the one sandwiched in the middle, thus, for example, meaning the second one if the total row number counts to three, the third one if the total row number counts to five, and so on. Besides, according to an optional embodiment of the present invention, each sub-slit of the transparent shutter also comprises a medial surface, which medial surface is perpendicular to the propagation direction of light received from the second light source within the transparent shutter. Again, for example, if the transparent shutter is positioned above the second light source, and light from the second light source is propagating from the bottom to up within the transparent shutter, the sub-slit extends horizontally within the transparent shutter and the medial surface thereof can be a horizontal plane cutting through the sub-slit at the middle. Further preferably, in the above embodiment of the present invention, the first surface and the second surface of each sub-slit are configured as mirror symmetrical to each other with respect to the medial surface of the respective sub-slit, making it easier for carving sub-slits within the transparent shutter and providing an accurate control over the redirection of light coming out from the second light source.

According to an optional embodiment of the present invention, in the above proposed front-lighting system for a vehicle, the plurality of sub-light sources are arranged especially in an array of 1 row and (2n+3) columns, where n is an integer equal to or greater than 0, meaning that only one row of sub-light sources is comprised in the second light source. In this case, the air-exposed slit comprises accordingly one single sub-slit. In an example instance of the above embodiment, for the single sub-slit of the transparent shutter, the first surface comprises two side sections, which are located respectively on either side of the middle part of the transparent shutter. Optionally, each side section of the first surface of the single sub-slit is curved, especially being convex towards the second light source. Alternatively, each side section of the first surface of the single sub-slit comprises a sloped surface, wherein a portion of the sloped surface adjoining the middle part of the transparent shutter is spaced farthest from the second light source as compared with remaining portions thereof. Further alternatively, each side section of the first surface of the single sub-slit comprises a stepped surface with one or more steps. According to one example instance, each step comprises a curved surface being convex towards the second light source. According to another example instance, each step comprises two facets—a first facet and a second facet. The first facet is configured to be perpendicular to the medial surface of the single sub-slit. The second facet is sloped and has a portion thereof closest to the middle part of the transparent shutter, wherein such a closest portion of the second facet is spaced farthest from the second light source as compared with remaining portions thereof. In a similar way, the second surface of the single sub-slit also comprises two side sections, with each located on either side of the middle part of the transparent shutter. Especially, for the single sub-slit, the second surface is mirror symmetric to the first surface with respect to its medial surface. Thus, specific constructions for the second surface can be obtained easily for a skilled person in the art based on the above detailed structures of the first surface, thus not being repeated herein for simplicity.

According to yet another embodiment of the above front-lighting system, the transparent shutter is further designed to project the light received from the second light source via the second primary optics onto the secondary optics through total internal reflection. A total internal reflection in the transparent shutter helps to fold the light path, so as to keep the first light source and the second light source, such as the low-beam light source and the high-beam light source, away from each other within the whole system. For example, the high-beam light source and the low-beam light source can be located at a distance larger than 20 mm in the assembled system. In this way, the heat dissipation can be improved, and the color non-uniformity of the final beam pattern can also be lowered. As a further preferable instance, the total internal reflection can occur one or more times within the transparent shutter, which facilitates a further reduction in size of the front-lighting system. In this way, the horizontal and/or vertical dimensions of the front-lighting system can be shortened, and the whole system becomes more compact.

In an exemplary embodiment of the above front-lighting system, the first light source is placed in a first focal plane of the first primary optics, and the second light source is placed in a first focal plane of the second primary optics. Besides, the transparent shutter is placed in one or more of: a second focal plane of the first primary optics, a second focal plane of the second primary optics, and a focal plane of the secondary optics, especially in all these three focal planes at the same time. Preferably, the transparent shutter is placed in the focal points of these focal planes. Apparently, those skilled in the art, having benefited from teachings of the present invention, can conceive a further positioning for various components, such as the first primary optics, the second primary optics, the secondary optics, the transparent shutter, and the two light sources, in the front-lighting system. The present invention should not be limited to those dispositions in respective focal planes or focal points.

According to an optional embodiment of the present invention, in the above proposed front-lighting system for a vehicle, the transparent shutter is made of polymethyl methacrylate (PMMA) or polycarbonate (PC). However, it should be noted that based on the teaching of the present invention, those skilled in the art will easily obtain other suitable materials and also suitable manufacturing or processing processes for the transparent shutter and the air-exposed slit carved therein. The present invention should not be limited in this regard. According to an exemplary implementation, the transparent shutter in the above proposed front-lighting system can be manufactured by injection molding as a one-piece plastic component, and the air-exposed slit can be carved therein for example by laser means. Obviously, this is just disclosed as an example and the present invention is not restricted only to it.

It will be appreciated by those skilled in the art that two or more of the above disclosed embodiments, implementations and/or aspects of the present invention may be combined in any way deemed useful. Different modifications and variations of the front-lighting system for a vehicle can be carried out by a person skilled in the art based on the disclosure of the present disclosure.

BRIEF DESCRIPTION OF THE DRAWINGS

These and other aspects of the present invention will be described now in more detail, with reference to the appended drawings showing embodiments and forming a part of the present invention. Specifically, in the drawings.

DETAILED DESCRIPTION OF THE EMBODIMENTS

Figure 1:
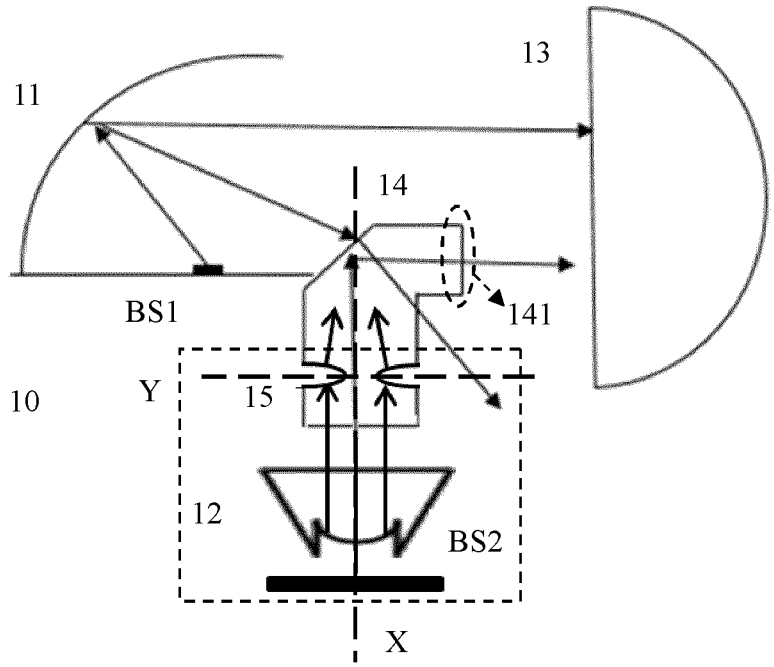
FIG. 1 schematically illustrates a front-lighting system for a vehicle according to an embodiment of the present invention, where the front-lighting system comprises a reflector and a collimator.

While the present invention is susceptible of embodiments in many different forms, there is shown in the drawings and will be described in detail herein only one or more specific embodiments, with the understanding that the present description is to be considered as exemplary of the basic principle of the present invention and not intended to limit the present invention only to the specific embodiments shown and described herein.

It should be noted that various components in different figures are not drawn to scale. Besides, relative positions between individual elements shown in the figures are only used to illustrate the basic principle of the present invention and should not be considered to limit the scope of the present invention.

With reference to FIG. 1, a front-lighting system 10 is proposed for a vehicle according to an embodiment of the present invention. Specifically, the front-lighting system 10 mainly comprises a first light source BS1, a second light source BS2, a first primary optics 11, a second primary optics 12, a secondary optics 13, and a transparent shutter 14. Preferably, in the above proposed front-lighting system 10, the first light source BS1 is configured to provide a low-beam pattern, i.e., acting as a low-beam light source, and in the meanwhile, the second light source BS2 is configured to provide a high-beam pattern, i.e., acting as a high-beam source. Alternatively, with another configuration of the transparent shutter 14, it could also be the other way around. That is, the low-beam pattern is provided by the second light source BS2, and the first light source BS1 is used as the high-beam light source. In the specific embodiment as shown by FIG. 1, the first primary optics 11 is chosen as a reflector, the second primary optics 12 is a collimator, and the secondary optics 13 is selected as a projection lens. Furthermore, the first light source BS1 is positioned in a focal plane, especially in a focal point, of the reflector 11, and the transparent shutter 14 is located in another focal plane, especially in another focal point, of the same reflector 11. Obviously, this special arrangement of the first light source BS1 and the transparent shutter 14 with respect to focal points of the reflector 11 is just disclosed as specific examples, for the purpose of explaining the basic principle of the present invention. Those skilled in the art, having benefited from the teaching of the present invention, will find it easy to acquire some other alternatives. In a similar way, the second light source BS2 can also be positioned in a focal plane, especially in a focal point, of the second primary optics 12, and the transparent shutter 14 is positioned in another focal plane, especially in another focal point, of the second primary optics 12. Additionally, the transparent shutter 14 itself can also be located in a focal plane, especially a focal point, of the secondary optics 13. Again, this special positioning in a corresponding focal plane or focal point should not be interpreted to be limiting.

In the specific embodiment as shown by FIG. 1, the first primary optics 11, i.e., the reflector 11 (also indicated as the first primary reflector), is configured to receive light from the first light source BS1, and then project part of it onto the transparent shutter 14 and part of it onto the secondary optics 13. With regard to the part of the light projected onto the transparent shutter 14 by the first primary reflector, a lower portion of it will be prevented from entering the projection lens. Especially, as shown in FIG. 1, a lower part of the light from the first primary optics 11 is refracted away from the secondary optics 13, and at the end possibly absorbed elsewhere within the system. In this case, the lower part of light from the first primary optics 11 will not form any image through the secondary optics 13. Specially, in case that the first light source BS1 is configured to be a low-beam light source, only the upper part of light emitted by the low-beam light source can pass through the projection lens, thus forming a low beam pattern with a clear cut-off line.

Further, discussions with relevance to the other beam portion, i.e., the one emitted by the second light source BS2, are provided in the following. With continued reference to FIG. 1, the transparent shutter 14 is configured further to receive light from the second light source BS2 via the second primary optics 12 and project it onto the secondary optics 13. In particular, the second light rays can be projected from the transparent shutter 14 onto the secondary optics 13 horizontally. In this case, the projection of light from the second light source BS2 (received via the second primary optics 12) onto the secondary optics 13 is obtained by means of a total internal reflection within the transparent shutter 14. Optionally, the diversion of the light propagation direction, by 90° in FIG. 1, can occur only once within the transparent shutter 14, just as the case shown in FIG. 1. After the total internal reflection, a second beam pattern, such as a high beam pattern if the second light source BS2 is configured as a high-beam light source, will be projected onto a road in front of the vehicle by the secondary optics 13. Again, in an optional instance, a projection lens can be used as the secondary optics 13, but the present invention is not limited to it.

With a transparent shutter 14 incorporated into a front-lighting system 1 for a vehicle, the traditional opaque shutter is replaced and no dark area will be observed in the final projected beam pattern, especially between the high beam pattern and the low beam pattern. This is definitely distinguished from the beam pattern obtained by an existing headlamp with an opaque shutter equipped. In other words, in the front-lighting system 1 for a vehicle as proposed by the present invention, a clear cut-off line is formed in the projected low beam pattern without any shading.

Besides, as also shown in FIG. 1, the transparent shutter 14 in the above proposed front-lighting system 1 comprises further a light out-coupling surface 141, at which light is out-coupled towards the secondary optics 13. The light out-coupling surface 141 is preferably designed to be flat or in a free form, which helps to change the out-coupled light in angle and/or distribution.

With continued reference to FIG. 1, in the above proposed front-lighting system 1 for a vehicle, the transparent shutter 14 also comprises an air-exposed slit 15, consisting of for example two curved parts at left and right sides respectively. As shown in FIG. 1, the air-exposed slit 15 is carved within the transparent shutter 14, and configured further to redirect the light received by the transparent shutter 14 from the second light source BS2 (especially, via the second primary optics 12) towards a middle axis X of the transparent shutter 14. For example, in the embodiment of FIG. 1, the transparent shutter 14 comprises a lower cylinder portion having a symmetry, middle axis X, wherein the air-exposed slit 15 is carved within the lower cylinder portion. To be specific, as shown in FIG. 1, the air-exposed slit 15 consists of two side parts located at respective sides of the middle axis X of the transparent shutter 14. In this case, the portion of light coming out from the second light source BS2 and entering the transparent shutter 14, especially its side parts at the left and right, will be incident onto the air-exposed slit 15 and refracted thereby towards the middle axis X of the transparent shutter 14. See for example the arrowed light rays shown schematically in FIG. 1. This helps to concentrate the incident light beam from the second light source BS2 towards the middle axis X of the transparent shutter 14, thus helping to reduce the second light beam in size, and also to avoid the loss of light that was otherwise caused for example by an outward refraction at outer edges of the transparent shutter 14.

With further reference to FIG. 1, in the above proposed front-lighting system 10, the second light source BS2 and its second primary optics 12 are both disposed right beneath the transparent shutter 14, especially under its lower cylinder portion. In this case, the second light part coming out of the second light source BS2 via the second primary optics 12 is incident onto a lower surface of the lower cylinder portion of the transparent shutter 14, refracted into it, and then propagating from the bottom to up therethrough, i.e., propagating vertically in the figures. Furthermore, as shown in FIG. 1, in the transparent shutter 14, the air-exposed slit 15 has a horizontal extending direction Y which is perpendicular to the middle axis X of the transparent shutter 14 forming the propagation direction of light from the second light source BS2. This contributes to an effective redirection of the light towards the middle axis X of the transparent shutter 14. It should be understood that there might also be a possibility for the light coming out from the second light source BS2 to undergo some reflections and/or refractions when passing through the transparent shutter 14, but the propagation direction herein refers to a general direction in which the light from the second light source BS2 travels through the whole transparent shutter 14. Thus, in the embodiment as shown by FIG. 1, the propagation direction of light from the second light source BS2 is vertical in the lower part of the transparent shutter 14, but changes to horizontal in the upper part of the transparent shutter 14. Having benefited from the teaching of the present invention, a skilled person in the art shall easily understand the meaning of the term "propagation direction of light from second light source within transparent shutter" according to different structure forms of the transparent shutter.

Figure 2:
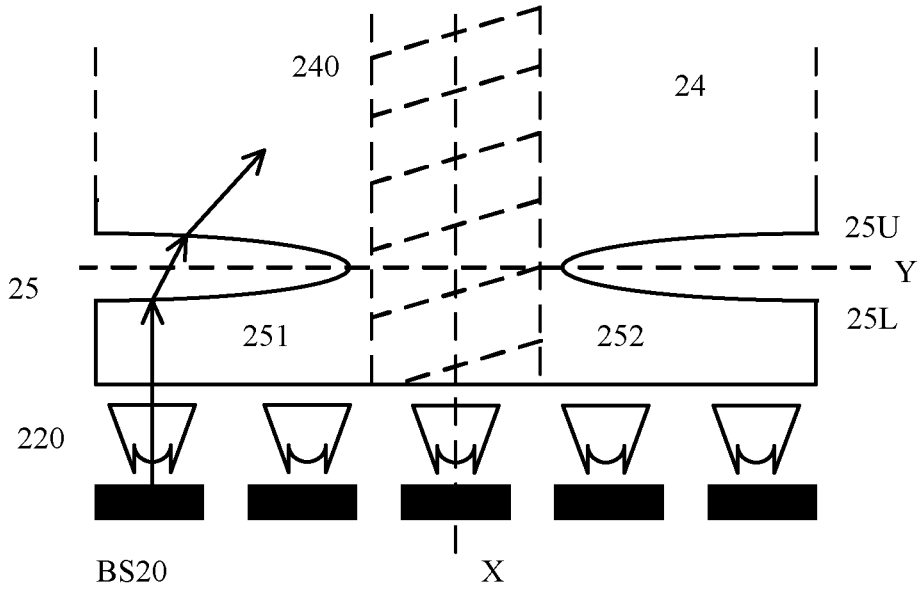
FIG. 2 schematically illustrates an enlarged view for a portion of a front-lighting system for a vehicle according to an embodiment of the present invention, which portion is indicated by a dashed box in FIG. 1.

With reference to FIG. 2, an enlarged view for a portion of a front-lighting system for a vehicle is shown according to an embodiment of the present invention, which portion is indicated by a dashed box in FIG. 1, and apparently comprises at least the second light source, the second primary optics and the part of transparent shutter containing the air-exposed slit. As shown in FIG. 2, according to an embodiment of the present invention, the second light source comprises a plurality of sub-light sources arranged especially in an array, for example five sub-light sources BS20 arranged in 1 row and 5 columns. Accordingly, the second primary optics may comprise five sub-optics 220 as well, wherein each is configured to receive and redirect light from a respective sub-light source BS20 towards the transparent shutter 24. It should be noted that the total number of five sub-light sources and accordingly of five sub-optics as shown in FIG. 2 is only illustrated as an example for helping to grasp the technical essence of the present invention, rather than limiting the protection scope of the present invention. As a matter of fact, in practical implementations, a skilled person in the art, having benefited from the teaching of the present invention, shall easily conceive other suitable numbers and/or arrangements of the sub-light sources and the sub-optics, such as a plurality of sub-light sources in an array of (2m+1) rows and (2n+3) columns, where m and n are both integers equal to or greater than 0, and/or one or more sub-optics each corresponding to a single sub-light source, a row of sub-light sources, a column of sub-light sources, or an array of sub-light sources.

With continued reference to FIG. 2, in case that multiple sub-light sources BS20 are comprised in the second light source, the air-exposed slit of the transparent shutter 24 consists only of a single sub-slit 25, which extends along a direction Y in parallel to the row of sub-light sources BS20 situated right below, and accordingly perpendicularly to the middle axis X of the transparent shutter 24. To be specific, as shown in FIG. 2, the only sub-slit 25 comprises two independent, side parts 251, 252 being located at either side of a middle part 240 (indicated by an dashed shadow area in the figures) of the transparent shutter 24, wherein the middle part 240 of the transparent shutter 24 refers to a cylinder part of the transparent shutter 24 centered for example around the middle axis X thereof. Especially, the sub-slit 25 is also shaped to have a first surface 25L and a second surface 25U being opposite to each other (i.e., the lower and upper surfaces in the figures), wherein as compared with the second, upper surface 25U, the first, lower one 25L is positioned closer to a light incident surface (i.e., a lower surface) of the transparent shutter 24. Preferably, the first surface 25L and the second surface 25U of the sub-slit 25 are mirror symmetric to each other with respect to a medial surface of the sub-slit 25, which medial surface is for example a horizontal plane cutting through the sub-slit 25 at the middle in the embodiment shown by FIG. 2. Further optionally, with reference to FIG. 2, the first, lower surface 25L of the sub-slit 25 comprises two side sections located respectively at the two side parts 251, 252 of the sub-slit 25, i.e., a left side section being the lower surface of the left side part 251 and a right side section being the lower surface of the right side part 252. The same applies to the second, upper surface 25U of the sub-slit 25 as well, i.e., comprising a left side section being the upper surface of the left side part 251 and a right side section being the upper surface of the right side part 252.

According to an optional embodiment as for example shown by FIG. 2, the left side part 251 and the right side part 252 of the sub-slit 25 both have its respective lower surface being convex towards the array of sub-light sources BS20, i.e., towards the second light source, while have its respective upper surface being convex away from the array of sub-light sources BS20, i.e., away from the second light source, especially with the same curvature as the respective lower surface. This helps to refract light rays received from the sub-light sources BS20 (such as via the second primary optics) at the sub-slit 25, specifically at the upper and lower surfaces of the two side parts 251, 252 thereof, thus changing them to be more inclined towards the middle part 240 of the transparent shutter 24. The effect of inclination towards the middle part 240 of the transparent shutter 24 can be seen explicitly from the simulated results in FIGS. 3(*a*) and 3(*b*), where simulated light intensity distributions on a vertical screen positioned in front of a front-lighting system are shown respectively provided without and with an air-exposed slit within the transparent shutter. As shown, in case that no air-exposed slit is provided in the transparent shutter, the simulated light intensity distribution exhibits a multi-maxima pattern, see for example the three-maxima pattern in FIG. 3(*a*). By contrast, if an air-exposed slit is introduced into the transparent shutter, like the sub-slit 25 of FIG. 2, the simulated light intensity distribution will have only one maximum in a center spot, see for example the single-maximum pattern in FIG. 3(*b*). Obviously, this is attributed to the inclination of light caused by the air-exposed slit towards the middle part of the transparent shutter. Further preferably, according to an embodiment of the present invention, the single concentrated light spot on the light out-coupling surface of the transparent shutter also shows a distribution of light intensity such that the light intensity is largest at a center, but reduces gradually towards outer edges. This is beneficial for providing a desired distribution of light intensity for example to the high-beam pattern as projected onto the road in front of the vehicle, if the second light source is configured to be a high-beam light source.

Figure 3A:
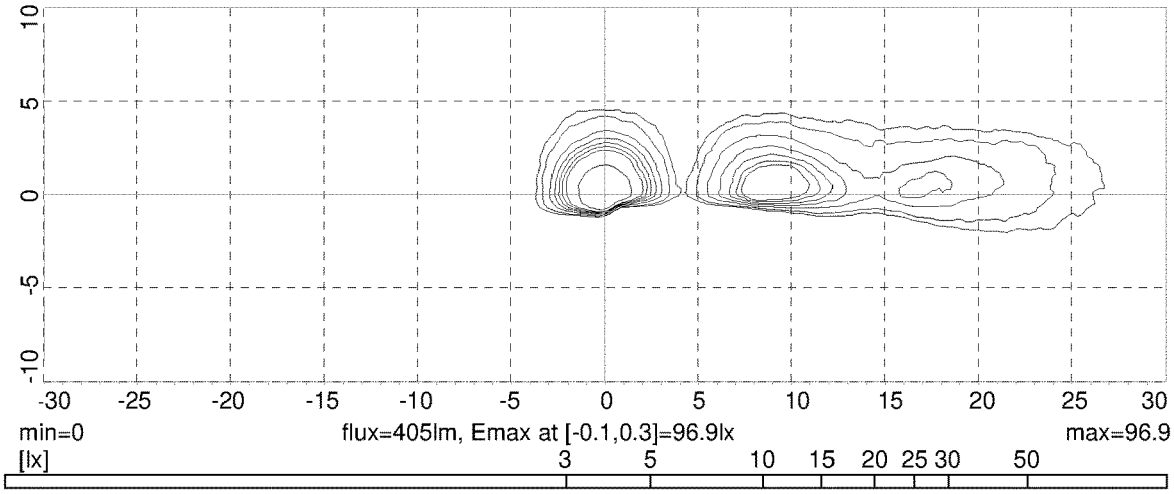
FIGS. 3(*a*) and 3(*b*) schematically illustrates simulated results for the light intensity distribution on a vertical screen positioned in front of a front-lighting system for a vehicle provided without and with an air-exposed slit within the transparent shutter respectively.
Figure 3B:
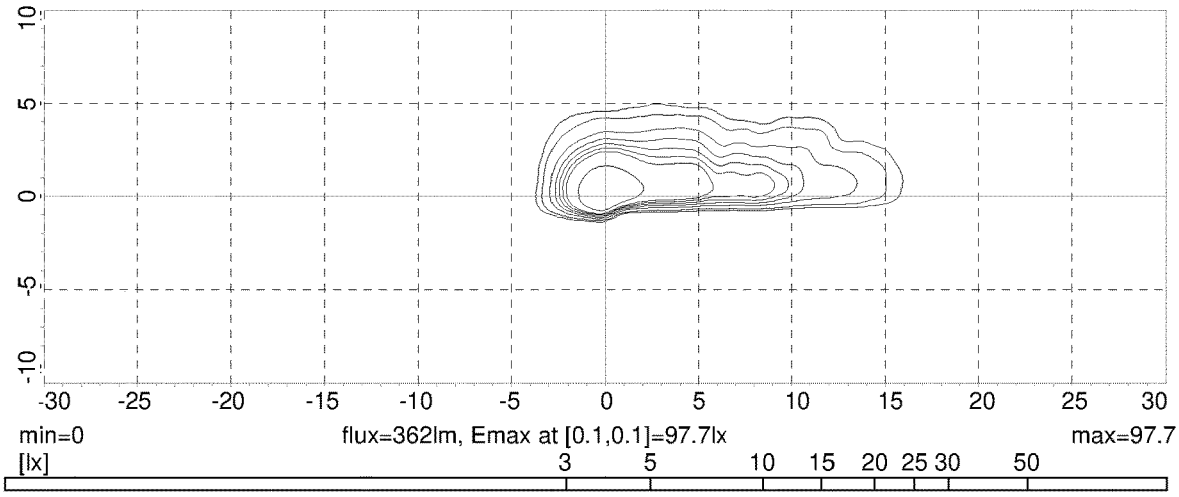

Apart from the single-maximum characteristic, as also evident from a comparison between FIGS. 3(*a*) and 3(*b*), the whole pattern on the light out-coupling surface of the transparent shutter is also reduced in size when the air-exposed slit is provided within the transparent shutter. This means that a large input light beam can be narrowed down when passing through the air-exposed slit of the transparent shutter, thus facilitating usage of a larger-sized, high-beam light source as compared with no air-exposed slit, or rendering it possible to use an array of sub-light sources for the second, high-beam light source rather than a single one of it. In this way, the high-beam pattern as projected finally onto the road in front of the vehicle can be provided with a higher, concentrated light intensity, making it more favorable for use in practical vehicle applications.

Figure 4:
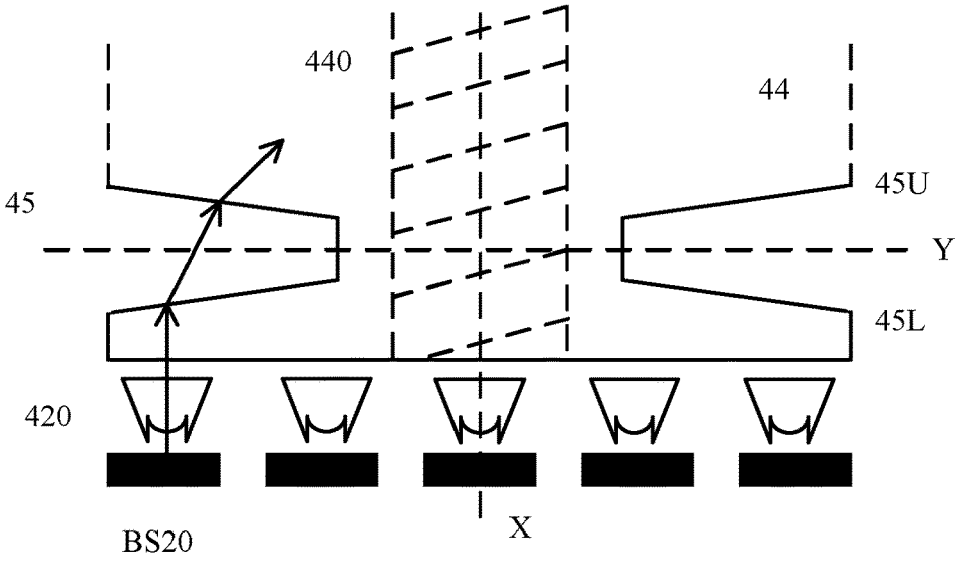
FIG. 4 schematically illustrates an enlarged view for a portion of a front-lighting system for a vehicle according to another embodiment of the present invention, which portion is indicated by a dashed box in FIG. 1.
Figure 5:
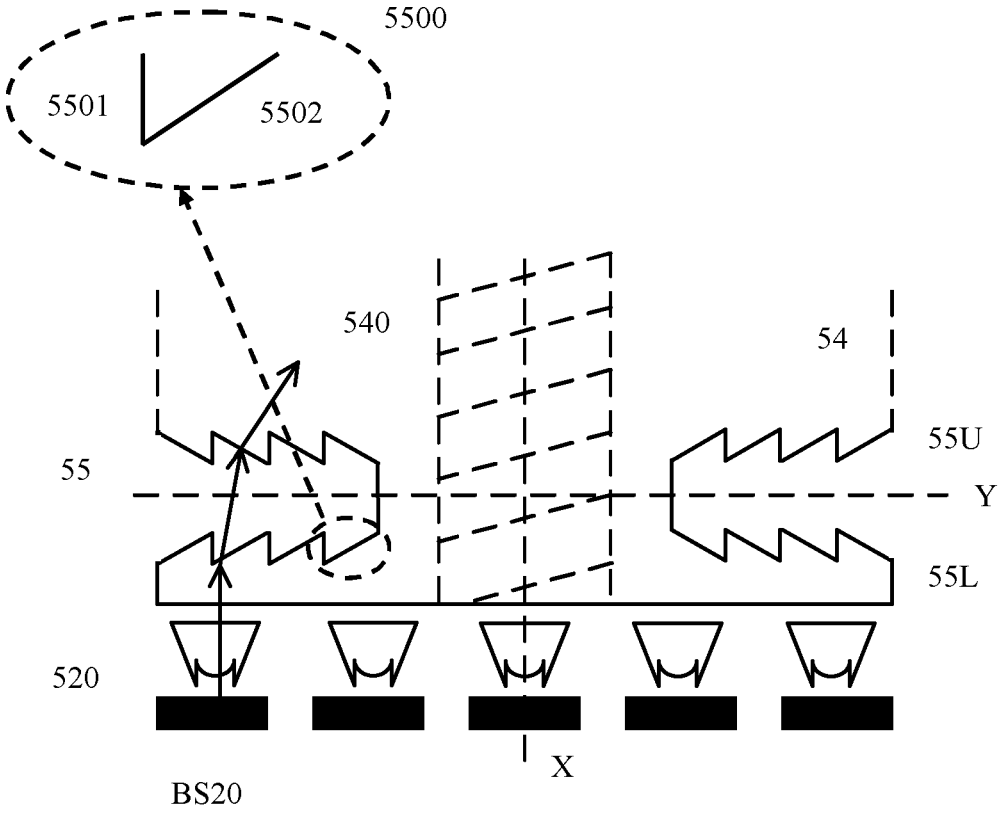
FIG. 5 schematically illustrates an enlarged view for a portion of a front-lighting system for a vehicle according to a further embodiment of the present invention, which portion is indicated by a dashed box in FIG. 1.

With reference to FIGS. 4 and 5, alternative constructions for the air-exposed slit in the transparent shutter of the proposed front-lighting system are shown according to different embodiments of the present invention. As similar to FIG. 2, in both FIGS. 4 and 5, only enlarged views are provided for the portion indicated by a dashed box in the front-lighting system of FIG. 1. Thus, same or similar references are used in FIGS. 4 and 5 to indicate same or similar components, such as a row of sub-light sources BS20 for the second light source, a respective row of second primary optics with sub-optics 420, 520, transparent shutter 44, 54 and middle part 440, 540 thereof, as well as sub-slit 45, 55 of the air-exposed slit. Like those discussions about FIG. 2, in both FIGS. 4 and 5, light coming out of the sub-light sources BS20 is also projected upwards by the second primary sub-optics 420, 520, then incident into the transparent shutter 44, 54, and propagating therethrough from the bottom to up. Further, with the introduction of the air-exposed slit, specifically the sub-slits 45, 55, light propagating through the transparent shutter 44, 54 will encounter refractions at least at lower and upper surfaces of the sub-slits 45, 55, which is again similar to FIG. 2.

However, the difference from FIG. 2 is that the sub-slits 45, 55 in FIGS. 4-5 are now provided with different constructions. To be specific, the lower surface 45L of the sub-slit 45 in FIG. 4 is shaped to comprise two sloped side sections, i.e., a left sloped section and a right sloped section, each of them rising up gradually from outer edges (left or right edges) towards middle part 440 of the transparent shutter 44. As for the upper surface 45U of the sub-slit 45 in FIG. 4, a left sloped section and a right sloped section are comprised as well, but each of them falling down gradually from outer edges (left or right edges) towards middle part 440 of the transparent shutter 44, preferably with the same slope as the respective left or right sloped section of the lower surface 45L. Due to a similar refraction towards the middle part 440 of the transparent shutter 44, the sub-slit 45 in FIG. 4 contributes as well to a smaller-sized and single-maximum high-beam pattern out-coupled from the transparent shutter 44, if high-beam light sources are used as the sub-light sources BS20.

Turning to the enlarged view of FIG. 5, the lower surface 55L of the sub-slit 55 is shaped to comprise two stepped side sections, i.e., a left one and a right one, each containing one or more steps 5500. With reference to the further enlarged view (indicated by a dashed ellipse) of FIG. 5, each step 5500 of the sub-slit 55 comprises two facets 5501, 5502. For example, with respect to the lower surface 55L of the sub-slit 55, the first facet 5501 is configured to be vertical, i.e., being perpendicular to the horizontal, medial surface of the sub-slit 55, while the second facet 5502 is sloped, especially rising up gradually in a direction from outer edges (left or right edges) towards middle part 540 of the transparent shutter 54. Similarly, the upper surface 55U of the sub-slit 55 also comprises a first facet 5501 and a second facet 5502, wherein the first one 5501 is vertical as well, but the second one 5502 is sloped, especially falling down gradually in a direction from outer edges (left or right edges) towards middle part 540 of the transparent shutter 54, as similar to the sloped section shown in FIG. 4. Like those discussions with relevance to FIG. 4, each step 5500 of the sub-slit 55 helps to redirect light incident thereon to be more inclined towards the middle part 540 of the transparent shutter 54, thereby contributing together to form a smaller-sized and single-maximum high-beam pattern on the light out-coupled surface of the transparent shutter 54, if high-beam light sources are used as the sub-light sources BS20. It should be noted herein that although not shown in the above embodiment of FIG. 5, each step 5500 of the sub-slit 55 can be designed alternatively to comprise a single curved surface, rather than the first and second facets. In this case, the single curved surface can be shaped in a similar way as the sub-slit 25 of FIG. 2, i.e., being convex towards the second, sub-light sources BS20 for the lower surface 55L of the sub-slit 55, while convex in an opposite direction (that is, away from the second, sub-light sources BS20) for the upper surface 55U of the sub-slit 55. Again, this is beneficial for concentrating light incident onto the sub-slit 55 to be inclined more towards the middle part 540 of the transparent shutter 54.

Figure 6:
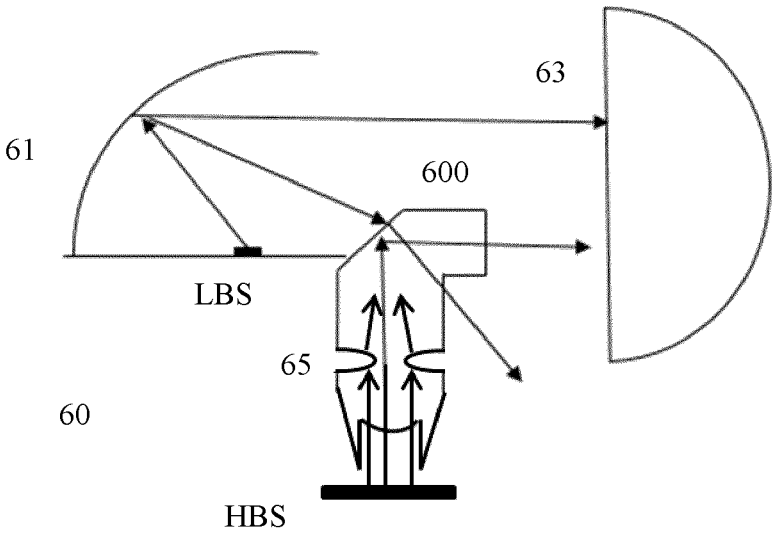
FIG. 6 schematically illustrates a front-lighting system for a vehicle according to another embodiment of the present invention, where the front-lighting system comprises a low-beam light source, a low-beam reflector, a high-beam light source and a high-beam collimator, and the high-beam collimator is integrated with the transparent shutter.

FIG. 6 schematically illustrates a front-lighting system 60 for a vehicle according to another embodiment of the present invention. The front-lighting system 60 in FIG. 6 basically stays the same as that in FIG. 1. Thus, similar reference numerals are used to indicate similar components, such as the first primary optics 61 (especially, a first primary reflector), the secondary optics 63 and the air-exposed slit 65. The difference between FIG. 6 and FIG. 1 lies in two aspects. In a first aspect, the first light source BS1 is now specified in FIG. 6 to be a low-beam light source LBS, and correspondingly, the second light source BS2 is a high-beam light source HBS. In a second aspect, the high-beam primary optics (such as the high-beam collimator) in FIG. 6 forms a collimating portion of the transparent shutter. That is to say, the transparent shutter and the second primary collimator are now integrated with each other, thus forming a one-piece component 600. The collimating portion of the integral component 600 here in FIG. 6 is arranged specifically for collimating the light emitted from the high-beam light source HBS towards the shutter portion thereof. Similarly to the second collimator in FIG. 1, a beam shaping of the high-beam light rays can be obtained in this way. But the difference from FIG. 1 is that in FIG. 6, the beam shaping of light emitted from the high-beam light source HBS occurs inside the one-piece component 600, which may be beneficial for quality improvements of the high-beam light rays.

Figure 7:
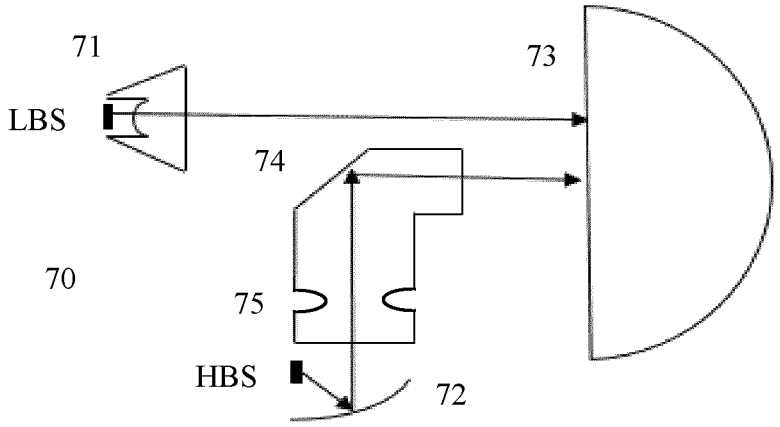
FIG. 7 schematically illustrates a front-lighting system for a vehicle according to a further embodiment of the present invention, where the front-lighting system comprises a low-beam light source, a low-beam collimator, a high-beam light source and a high-beam reflector.

FIG. 7 schematically illustrates another alternative front-lighting system 70 for a vehicle according to a further embodiment of the present invention. The front-lighting system 70 here in FIG. 7 is almost the same as that in FIG. 1. Thus, similar reference numerals are used to indicate similar components, such as the transparent shutter 74, the secondary optics 73 and the air-exposed slit 75. The difference between FIG. 7 and FIG. 1 lies in two aspects. In a first aspect, the first light source BS1 is specified now in FIG. 7 to be a low-beam light source LBS, and correspondingly, the second light source BS2 is a high-beam light source HBS. In a second aspect, the first primary optics of FIG. 7 is designed to be a first collimator 71, not a first reflector; and the second primary optics is changed to be a second reflector 72, not a second collimator. In this case, the first collimator 71 helps to achieve not only a projection of light from the low-beam light source LBS onto the transparent shutter 74 and the secondary optics 73, but also a beam shaping of the same light. Also, the second reflector 72 will contribute to fold the propagation path for the light coming out from the high-beam light source HBS. It is important to indicate that only two specific embodiments are shown in FIGS. 1 and 7, where light coming from the first light source is reflected but light coming from the second light source is refracted (see FIG. 1), and light coming from the first light source is refracted but light coming from the second light source is reflected (see FIG. 7). This shall be never interpreted as limiting the present invention. In fact, having benefited from the teaching of the present invention, a skilled person in the art shall easily understand other similar embodiments, such as light from both the first and second light sources is reflected, or light from both the first and second light sources is refracted, and all these alternatives shall be encompassed within the protection scope of the present invention.

It should be noted that although in the figures, the total internal reflection of light coming from the second light source is shown to occur only once, this should not be interpreted as limiting the present invention. As a matter of fact, a skilled person in the art, having benefited from the teaching of the present invention, will easily conceive other suitable constructions of the transparent shutter such that the total internal reflection of light coming from the second light source occurs more than once within the transparent shutter. By means of multiple times of total internal reflection, the second, such as high-beam, light source may be installed at the same side as the first, such as low-beam, light source. That is to say, a vertical distance between the two light sources can be greatly reduced, and the large spacing is mainly achieved through a horizontal distance between them. In this way, a vertical space of the front-lighting system will be shortened significantly, and thus the whole system becomes very compact at least in vertical direction. Besides, with multiple times of total internal reflection, the light path within the front-lighting system can be folded such that the first, such as low-beam, light source will keep away from the second, such as high-beam, light source in space based on practical implementations. This helps to offer design flexibility, outstanding heat dissipation feasibility and less color non-uniformity.

It is also important to note that light rays shown in the figures, only represent part, but not all, of the light rays within the whole optical system. In fact, the light rays shown in all the figures are only used as representative examples for the purpose of illustrating the basic principle of the present invention, and clearly should not be read as exhaustive examples of all the light rays within the entire system.

With regard to the materials and manufacturing or processing processes suitable for the transparent shutter, different options can be used. For example, in an embodiment, the transparent shutter can be fabricated by injection molding as a one-piece component, such as by polymethyl methacrylate (PMMA), polycarbonate (PC), or other plastic materials. Apparently, materials other than plastic, and processes other than injection molding can also be utilized based on specific situations, and the present invention should not be limited in this aspect.

In should be noted as well that although the transparent shutter is shown in sectional views in all the figures of the present invention and seems to have a flat contour, the actual 3D shape of the transparent shutter, especially having the air-exposed slit introduced therein, might be rather complicated. In some embodiments, the transparent shutter can be designed to have a flat contour. Alternatively, in other embodiments, the transparent shutter can be designed as a curved body, maybe of a free-form contour. Specific illustrations about different contours of the shutter, both in the drawings and the specification, should not be interpreted to be limiting, but rather are to be considered as exemplary disclosures.

It should also be noted that the above-mentioned embodiments illustrate rather than limit the present invention, and that those skilled in the art will be able to design many alternative embodiments without departing from the scope and spirit of the present invention. Although the present invention has been described in connection with some embodiments, it is not intended to be limited to the specific forms as set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention.

Furthermore, although individual features may be included in different claims, these may possibly be advantageously combined, and the inclusion in different claims does not imply that a combination of features is not feasible and/or advantageous. In the claims, any reference signs placed between parentheses shall not be construed as limiting the claims. Use of the verb "comprise" and its conjugations does not exclude the presence of elements or steps other than those stated in a claim. The article "a" or "an" preceding an element does not exclude the presence of a plurality of such elements. Also, references to first, second etc. are merely to be considered as labels and do not imply or describe any ordering, sequence, relation or properties of the features prefixed by these terms. The mere fact that certain measures are recited in mutually different dependent claims does not indicate that a combination of these measures cannot be used to advantage.

LIST OF REFERENCE NUMERALS

10 front-lighting system
BS1 first light source
BS2 second light source
11 first primary optics
12 second primary optics
13 secondary optics
14 transparent shutter
141 light out-coupling surface of transparent shutter
15 air-exposed slit
X middle axis of transparent shutter
Y extending direction of sub-slit
BS20 sub-light source of second light source
220 sub-optics of second primary optics
24 transparent shutter
240 middle part or middle section of transparent shutter
25 sub-slit of air-exposed slit
251 252 side parts of sub-slit
25L first surface of sub-slit
25U second surface of sub-slit
420 sub-optics of second primary optics
44 transparent shutter
440 middle part or middle section of transparent shutter
45 sub-slit of air-exposed slit
45L first surface of sub-slit
45U second surface of sub-slit
520 sub-optics of second primary optics
54 transparent shutter
540 middle part or middle section of transparent shutter
55 sub-slit of air-exposed slit
55L first surface of sub-slit
55U second surface of sub-slit
5500 step of sub-slit
5501 first facet of step
5502 second facet of step
60 front-lighting system
LBS low-beam light source
HBS high-beam light source
61 low-beam reflector
600 one-piece or integral component
63 secondary optics
65 air-exposed slit
70 front-lighting system
71 low-beam collimator
72 high-beam reflector
73 secondary optics
74 transparent shutter
75 air-exposed slit

The invention claimed is:

1. A front-lighting system for a vehicle, the system comprising:

a first light source;
a second light source;
a transparent shutter;
a secondary optics;
a first primary optics configured to receive light from the first light source and project the light onto the transparent shutter and the secondary optics; and
a second primary optics configured to receive light from the second light source and project the light onto the transparent shutter;
the transparent shutter being configured to receive light from the first light source via the first primary optics and prevent a lower part of the light, as seen when installed in the vehicle, from entering the secondary optics,
the transparent shutter being further configured to receive light from the second light source via the second primary optics and project the light onto the secondary optics, and
the secondary optics being configured to receive light from the first primary optics and the transparent shutter and project the light onto a road in front of the vehicle, and
the transparent shutter comprising an air-exposed slit that extends perpendicularly to a direction in which the light received by the transparent shutter from the second light source propagates within the transparent shutter to redirect the light received by the transparent shutter from the second light source towards a middle axis of the transparent shutter.

2. The front-lighting system according to claim 1, wherein the air-exposed slit is further configured to redirect the light received by the transparent shutter from the second light source into a concentrated light spot on a light out-coupling surface of the transparent shutter.

3. The front-lighting system according to claim 1, wherein:
the second light source comprises a plurality of sub-light sources arranged in an array of (2m+1) rows and (2n+3) columns, wherein m and n are both integers equal to or greater than 0, and
the air-exposed slit comprises one or more sub-slits, wherein each sub-slit extends in parallel to a respective row of the sub-light sources and comprises two side parts, one on either side of a middle part of the transparent shutter being exempted from the sub-slits.

4. The front-lighting system according to claim 3, wherein:
each sub-slit further comprises a first surface and a second surface opposite to the first surface,
the first surface is closer than the second surface to a surface of the transparent shutter where light from the second light source is incident thereon, and
at least portions of the first surface and the second surface located at the two side parts of each sub-slit are shaped to refract light incident thereon to be inclined towards the middle part of the transparent shutter relating to a middle-positioned sub-slit, which middle-positioned sub-slit has an equal number of sub-slits at either side thereof.

5. The front-lighting system according to claim 4, wherein:
each sub-slit comprises a medial surface perpendicular to the direction in which the light received by the transparent shutter from the second light source propagates within the transparent shutter, and the first surface and the second surface of each sub-slit are mirror symmetrical to each other with respect to the medial surface of the respective sub-slit.

6. The front-lighting system according to claim 5, wherein the plurality of sub-light sources are arranged in an array of 1 row and (2n+3) columns, wherein n is an integer equal to or greater than 0, and the air-exposed slit comprises a single sub-slit.

7. The front-lighting system according to claim 6, wherein:

the first surface comprises two side sections located on either side of the middle part of the transparent shutter relating to the single sub-slit, and each side section comprises a curved surface convex towards the second light source.

8. The front-lighting system according to claim 6, wherein:

the first surface comprises two side sections located on either side of the middle part of the transparent shutter relating to the single sub-slit, and each side section comprises a sloped surface, a portion thereof adjoining the middle part being spaced farthest from the second light source as compared with remaining portions thereof.

9. The front-lighting system according to claim 6, wherein the first surface comprises two side sections located on either side of the middle part of the transparent shutter relating to the single sub-slit, wherein each side section comprises a stepped surface with one or more steps, wherein each step comprises a curved surface convex towards the second light source.

10. The front-lighting system according to claim 6, wherein the first surface comprises two side sections located on either side of the middle part of the transparent shutter relating to the single sub-slit, wherein each side section comprises a stepped surface with one or more step, where each step comprises a first facet and a second facet, wherein the first facet is perpendicular to the medial surface of the single sub-slit, and the second facet is sloped and has a portion thereof closest to the middle part of the transparent shutter relating to the single sub-slit, such closest portion of the second facet being spaced farthest from the second light source as compared with remaining portions thereof.

11. The front-lighting system according to claim 1, wherein the transparent shutter is made of polymethyl methacrylate (PMMA).

12. The front-lighting system according to claim 1, wherein:

the first light source comprises a low-beam light source, and the second light source comprises a high-beam light source.

13. The front-lighting system according to claim 1, wherein the transparent shutter is further configured to project the light received from the second light source via the second primary optics onto the secondary optics through total internal reflection.

14. The front-lighting system according to claim 1, wherein each of the first primary optics and the second primary optics comprises a reflector.

15. The front-lighting system according to claim 1, wherein the second primary optics is integrated with the transparent shutter.

16. The front-lighting system according to claim 1, wherein each of the first primary optics and the second primary optics comprises a collimator.

17. The front-lighting system according to claim 1, wherein the transparent shutter is made of polycarbonate (PC).

* * * * *